US006815611B1

(12) United States Patent
Gareis

(10) Patent No.: US 6,815,611 B1
(45) Date of Patent: Nov. 9, 2004

(54) HIGH PERFORMANCE DATA CABLE

(75) Inventor: Galen M. Gareis, Richmond, IN (US)

(73) Assignee: Belden Wire & Cable Company, Richmond, IN (US)

( * ) Notice: Subject to any disclaimer, the term of this patent is extended or adjusted under 35 U.S.C. 154(b) by 0 days.

(21) Appl. No.: 10/031,687

(22) PCT Filed: Jun. 14, 2000

(86) PCT No.: PCT/US00/16420

§ 371 (c)(1),
(2), (4) Date: Jun. 21, 2002

(87) PCT Pub. No.: WO00/79545

PCT Pub. Date: Dec. 28, 2000

Related U.S. Application Data

(60) Provisional application No. 60/141,462, filed on Jun. 29, 1999, and provisional application No. 60/139,927, filed on Jun. 18, 1999.

(51) Int. Cl.[7] ..... H01B 11/00
(52) U.S. Cl. ..... 174/36; 174/113 R
(58) Field of Search ..... 174/36, 113 R

(56) References Cited

U.S. PATENT DOCUMENTS 3,843,829 A * 10/1974 Bridges et al. ..... 174/36
4,096,346 A * 6/1978 Stine et al. ..... 174/36
4,860,343 A * 8/1989 Zetena, Jr. ..... 379/110.01
5,037,999 A * 8/1991 Van Deusen
5,149,915 A * 9/1992 Brunker et al.
5,434,354 A * 7/1995 Baker et al. ..... 174/36
5,486,649 A * 1/1996 Gareis ..... 174/36
5,574,250 A * 11/1996 Hardie et al. ..... 174/36
5,734,126 A * 3/1998 Siekierka et al. ..... 174/113 R
5,744,757 A * 4/1998 Kenny et al. ..... 174/113 R
5,767,442 A * 6/1998 Eisenberg et al. ..... 174/36
5,956,445 A * 9/1999 Deitz et al. ..... 385/100
6,010,788 A * 1/2000 Kebabjian et al.
6,403,887 B1 * 6/2002 Kebabjian et al. ..... 174/110 R

OTHER PUBLICATIONS

Disclosure from Danish Catalog, RS Radio Parts, Apr., 1997, Cited in Companion Danish Case.

* cited by examiner

*Primary Examiner*—Chau N. Nguyen
(74) *Attorney, Agent, or Firm*—Robert F. I. Conte; Barnes & Thornburg LLP

(57) ABSTRACT

An improved high performance twisted pair data cable (20) than has an impedance standard deviation of less than 3.5 when the standard deviation is calculated around an average impedance of 50 to 200 ohms and preferably 90 to 110 ohms. The twisted pair is helically wrapped with a metal shield tape (16) at a tension that provides a cross-sectional void of less than 25% and preferably less than 18% of the cross-sectional area of the shielded twisted pair cable. The tape is helically wrapped with an overlap of 30–45% and at an angle of 35–45 degrees with respect to the longitudinal axis of the cable. The cable has a rating up to 600 MHz.

10 Claims, 1 Drawing Sheet

HIGH PERFORMANCE DATA CABLE

This application claims the benefit of provisional applications 60/139,927 filed Jun. 18, 1999 and 60/141,462 filed Jun. 29, 1999.

FIELD OF THE INVENTION

This invention relates to high performance data cables that successfully enables transmission in the frequency range of 0.3 MHz to 600 MHz. More particularly, I provide a helical shielded twisted pair cable with a standard impedance deviation of 3.5 or less about the mean or average impedance of 50 to 200 ohms. Also, I provide a high performance data cable having a plurality of the helical shielded twisted pair cables and having an average standard deviation of 3.5 or less and with no single standard deviation for any of the cables being greater than 4.5.

BACKGROUND OF THE INVENTION

The current high performance data cables usually utilize as a shield a heavy, stiff, 2 mil aluminum tape with a 1 mil polyester (Mylar) backing. The shield is wrapped around each unshielded twisted pair subgroup within an application lay length that is equal to the length of the cables overall cable lay, typically lays of 4.0 to 6.0 inches. The tape is about 0.5 inches wide. The application angle of the wrapping is shallow, based on the long overall cable lay (5 inches) and the tape is almost parallel with the twisted pair laterally axis. A typical cable has 4 pairs of twisted pair cables with a 40 to 65% tinned copper braid applied over the four pairs and a final thermoplastic jacket extruded over the braided pairs to complete the cable. The shallow application angle of the metal shield tape generally creates the problem of allowing the tape to open up during the cabling operation before a binder or spirally applied drain wire can capture it.

Also, the tape doesn't generally follow the pairs contour under the tape. Tape gaps are created with this process around the unshielded twisted pair core that do not provide a sufficiently stable ground plane to meet the industry standard electrical requirements such as CENELEC pr EN 50288-4-1.

The known cable structure noted above is mechanically unsound in a static state, and the electricals are unstable under installation conditions since the single overall braid cannot adequately insure the tape lap doesn't "flower" open when the cable is flexed. This "flowering" increases NEXR, and further erodes impedance/RL performance as the ground plane is upset. This adds to attenuation nonuniformity. The impedance numbers are even worse under flexing since the conductor's center to center, as well as the ground plane, changes. The higher the bandwidth requirement, the worse these issues become.

SUMMARY OF THE INVENTION

My invention uses a spiral wrap shielding tape to meet impedance/RL, attenuation uniformity, and capacitance unbalance that is required.

My invention eliminates most of the trapped air that is normally found in shielded twisted pair cables. This is done by helically or spirally wrapping the shield with a 25–65% and preferably a 45–55% overlap. The shield has a 0.33 to 2.0 mil and preferably close to 1 mil metal layer, i.e., 0.75 to 1.25 mils. The helical or spiral wrap with its overlap combine to provide good shielding with improved impedance control. The consistent ground plane created along the cables length allows better capacitance unbalance.

My invention also provides for substantial geometric stability under flexing. My use of short lay shield tapes eliminate tape gaps and flowering under flexing by using tapes with my preferred tape overlap of 45 to 55% overlap and an angle of wrap that is 30 to 45° and no more than a 45° relative to the cable's longitudinal axis. This establishes a very stable level of physical and electrical performance under adverse use conditions. My twisted pair cable center to center distances indicated as (d) in FIG. 3, and conductor to ground distances, remain much more stable than those of the previous cables.

My cables are especially beneficial for use as category 7 and higher cables. This is especially true for those cables that I spirally or helically shield and are used out to 600 MHz. The typical high-performance data cable when made according to our invention, has four (4)twisted pair cables with each twisted pair cable made up of two foam or non-foam insulated (fluorocopolymer or polyolefin) singles. Each of the helical shielded twisted pair cables has my unique tight helical metal shield tape wrapped around it with the tape and its lateral short fold seam tightly held in place with a the tight 25 to 65% and preferably 45 to 55% overlap. The helical shielded twisted pairs are S-Z'd or planetary together into a bunched or bundled configuration. The bundled pairs may be bundled by an overall braid or thread—metal or fabric. A final thermoplastic jacket (fluorocopolymer or a polyolefin, i.e., polyvinyl chloride) is extruded over the bundled twisted pair cables.

Generally the metal shield is an aluminum tape or a composite tape such as a short fold BELDFOIL tape (this is a shield in which metal foil or coating is applied to one side of a supporting plastic film), or a DUOFOIL tape ( this is a shield in which the metallic foil or coating is applied to both sides of a supporting plastic film) or a free edge BELDFOIL tape. The overall metal thickness is 0.33 to 2.0 mil aluminum layer thickness and preferably about a 1.0 mil. Although aluminum is referred to, any suitable metal normally used for such metal and composite metal tapes can be used such as copper, copper alloy, silver, nickel, etc. Each twisted pair is wrapped with the metal facing outwardly and although the most preferred wrap is a 45 to 55% overlap. As noted above, the overlap may vary as a practical matter from 25 to 65%. The preferred shield that gives the best attenuation and impedance characteristics are those tapes that are joined to provide a shorting effect. However, with a suitable overlap, the short fold can be eliminated.

The number of shielded twisted pairs in a high performance data cable is generally from 4 to 8 but may be more if desired. The tension of the helically wrapped shield is such that the wrapped shield eliminates most of the trapped air to provide a standard impedance deviation for the helical shielded twisted pair cable and an average standard impedance deviation for the high performance data cable which has a plurality of helically shielded twisted pairs. The tension on the shielding tape and binder are such that there is only a 25% or less and preferably 18% or less void space of the entire cross-sectional area of the helical shielded twisted pair taken along any point in the length of the cable.

I provide a high performance twisted pair data cable having a shield helically wrapped around an unshielded twisted pair cable and if desired a fabric or metal braid or thread simultaneously or subsequently wrapped around the helical shield to additionally bind the shield. The wrapping of the shield and binder(the braid or thread) is at a tension such that for an individual twisted pair that may be used on its own, the individual pair has an unfitted impedance that has a nominal or standard impedance deviation of 3.5 or less for each helical shielded twisted pair cable that is rated for up to 600 MHz The high-performance data cable which has a plurality of helical shielded twisted pair cables and is rated at up to 600 MHz has an average standard impedance deviation for all of the plurality of helically shielded twisted pairs of 3.5 or less and with no single standard impedance deviation being greater than 4.5. The standard impedance deviation is calculated around a mean or average impedance of 50 to 200 ohms and preferably 90 to 110 ohms and with at least 350 frequency measurement taken on a 328 ft. or longer cable.

Other advantages of my invention will become more apparent upon reading the following preferred description taken in conjunction with the drawings.

DETAILED DESCRIPTION OF THE PREFERRED EMBODIMENTS

Figure 1:
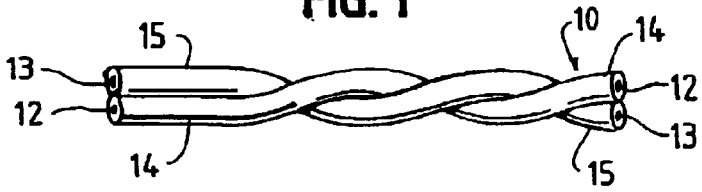
FIG. 1 is a perspective view of a twisted pair cable used in the present invention.

FIG. 1 illustrates a twisted pair cable 10 having a pair of conductors 12 and 13. Each of the conductors 12 and 13 have extruded thereon an appropriate insulation 14 and 15 which may be foamed or non-foamed fluorocopolymer or an appropriate polyolefin.

Figure 2:
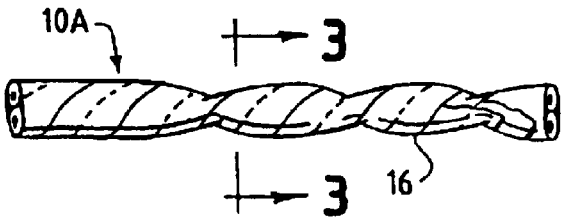
FIG. 2 is a perspective view of a tight helically wrapped twisted pair cable according to the present invention.

FIG. 2 illustrates the twisted pair of FIG. 1, tightly and helically wrapped with a metal shield 16. The metal shield can be any appropriate shield such as a metal tape or a composite tape with a non-metal base such as a polyester (i.e. MYLAR) having on one or both sides of the non-metal base a metal normally used in cable shields. The metal for the tape and the composite tape being aluminum, copper, copper alloy, nickel, silver, etc. The thickness of the overall metal is 0.33 to 2.0 mil and preferably 0.75 to 1.25 mil and close to 1.0 mil. The shield can be the short fold BELDFOIL type tapes, or the DUOFOIL type tapes which is a tape where metal is on both sides of the tape.

Figure 3:
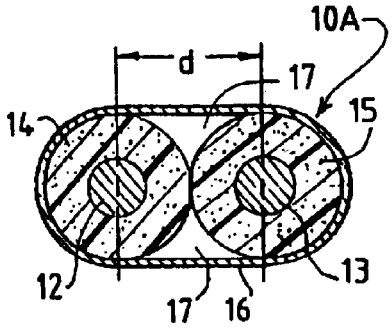
FIG. 3 is a cross-section taken along lines 3—3 of FIG. 2.

The tape 16 is helically wrapped with sufficient pressure as shown in FIG. 3 so as not to crush the insulation 14 and 15 but to provide a small void space 17 that is less than 25% of the entire cross-sectional area within the helical shielded twisted pair cable as shown in FIG. 3. This cross-sectional area is taken along any point along the lengths of the cable. Preferably the void space is less than 18% of the cross-sectional area. The tightly wrapped tape 16 conforms to the outer shape of the twisted pair 10 to provide the helical shielded twisted pair cable 10A. The tape 16 is wrapped at a 35° to 45° angle with the preferred 45–55% overlap. When the preferred overall metal thickness on the tape is 1.0 mil, this overlap allows the tape to have effectively a 2 mil metal thickness and still allow the shielded twisted pair to be very flexible. The width of the tape is 0.5 to 1.5 inches and is preferably approximately 0.75 inches. This tight wrapping provides the standard impedance deviation and the average standard impedance deviatiori noted above.

The insulation is preferably a foamed fluorocopolymer having a thickness of 0.010 to 0.060 inches and preferably 0.015 to 0.020 inches. The individual conductors 12 and 13 are generally 20 to 30 AWG and preferably 22 to 24 AWG.

The conductors can be solid or stranded and are preferably solid. The lay length for all of the four twisted pair cables 10 may be the same or different and right and/or left hand. The lay is preferably 0.3–2.0 inches. The overall cable lay is generally 10 to 20 times the cable's average core diameter.

Figure 4:
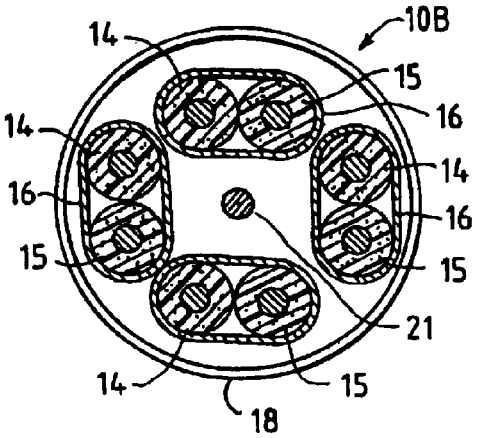
FIG. 4 is a cross-section of four of the helically wrapped twisted pair cables of FIGS. 2 and 3 being bundled and wrapped by a braid to provide a braided cable according to the present invention.

Referring to FIG. 4, four (4) of the shielded twisted pair cables 10A are bundled together and tightly held together by a braid 18 to provide the braided cable 10B. The braid 18 is a metal, is 40 to 90% and preferably a 45–65% metal or fabric braid. The metal braid can be a tinned copper braid but can be any type metal braid that would be appropriate for a high performance category 7 data cable. i.e. copper, copper alloy, bronze (a copper alloy which alloying element is other than nickel or zinc, i.e., copper-cadmium alloy), silver, etc.

Figure 5:
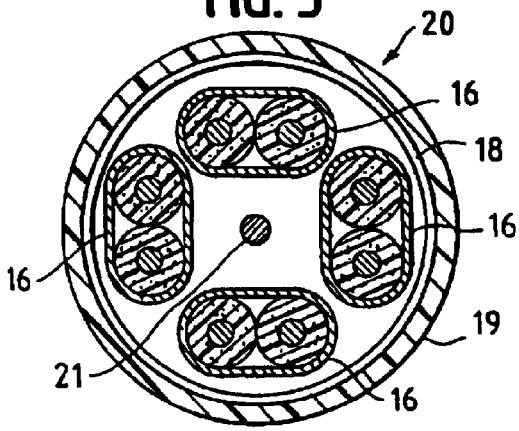
FIG. 5 is a cross-section of a cable containing the braided cable of FIG. 4.
Figure 6:
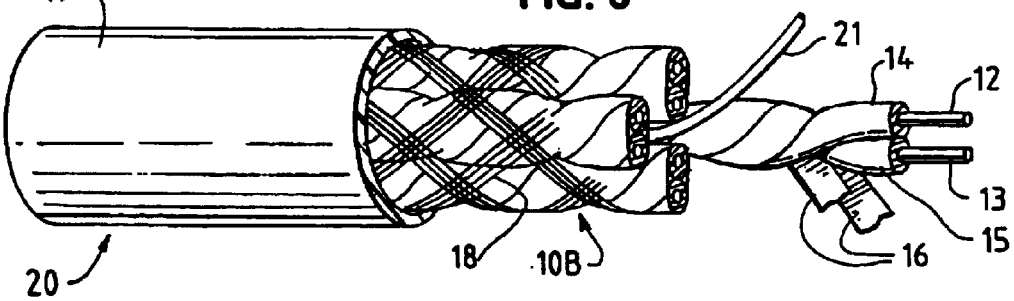
FIG. 6 is a perspective view of the cable of FIG. 5.

Referring to FIGS. 5 & 6, the cable 10B of FIG. 4 has a jacket 19 extruded thereover to produce my high performance data cable 20. The jacket can be any suitable jacket material that would be suitable for a category 7 cable a thermoplastic polyolefin such as flame retardant polyethylene, polyvinyl chloride, etc. or a fluroinated polymer such as fluorinated ethylene propylene.

A ground wire 21 is between the cables 10A but can be located in any suitable location such as around the bundled twisted pair cables, used instead of the braid 18 and between the jacket and the braid 18.

Also, as noted above, the braid 18 can be a fabric braid or an appropriate thread such as Aramid 760. This is also the case if a binder is desired around each helically shielded twisted pair cable 10A.

As it is shown in my following example, my high performance cable 10B has 4 helical shielded twisted pair cables bundled by a metal braid. The test for the Example was the impedance tests as required by CENELEC and was conducted on 328 ft. length of the cable. The helical shield was a BELDFOIL tape having a 1 mil aluminum thickness. The tape was helically wrapped at about a 45° angle having approximately a 50% overlap. Impedance measurements stared at 0.3 MHz and at least three hundred and fifty (350) impedance measurements were taken from about 1.0 to 600 MHz. The cable conductors 12 and 13 were 22 AWG solid copper and the insulations 14 and 15 were foamed FEP. All of the helical shielded twisted pair cables have a void 17 of less than 18%.

EXAMPLE

A 328 ft. length of the above high-performance data cable 20 having four helical-shielded twisted pair cables 10B bundled with a metal braid was tested at 23.0° C. The impedance for each of the four helical-shielded twisted pair cables was measured over 0.3 to 600 MHz. At least 350 measurements were taken between 1.0 and 600 MHz.

The first helical shielded twisted pair cable had a standard impedance deviation of 3.2294 taken around a mean impedance of 98.5280.

The second helical shielded twisted pair cable had a standard impedance deviation of 2.7208 taken around a mean impedance of 96.5.

The third helical shielded twisted pair cable had a standard impedance deviation of 2.8652 taken around a mean impedance of 97.9824.

The fourth helical shielded twisted pair cable had a standard impedance deviation of 2.6130 taken around a mean impedance of 100.4164.

The high-performance cable 20 of this example had an average standard impedance deviation of 2.8751 (3.2294+2.7208+2.8652+2.6130)/4). The following shows the data.

It will, of course, be appreciated that the embodiments which have just been described have been given by way of illustration, and the invention is not limited to the precise embodiments described herein. Various changes and modifications may be effected by one skilled in the art at without departing from the scope or spirit of the invention as defined in the appended claims.

I claim:

1. A helical shielded twisted pair data cable comprising an individual insulated twisted pair cable, a shielding tape selected from the group consisting of a metal tape, a first composite tape having a non-metal base and a layer of metal on one side of said base, and a second composite tape having a non-metal base and a layer of metal on both sides of said base;

said shielding tape being helically wrapped with an overlap of 45–55% and at an angle to the longitudinal axis of the twisted pair cable of 30–45° around said twisted pair cable;

said shielding tape having a metal thickness of 0.75 to 1.25 mils;

said shielding tape being wrapped around said twisted pair at a tension to eliminate a substantial amount of the air to leave a cross-sectional void area of less than 18% of the cross-sectional area of the shielded twisted pair cable to provide said helical shielded twisted pair data cable; and to provide said helical shielded twisted pair data cable with a rating at least out to 600 MHz and an adjusted to 20° C. standard impedance deviation of 3.5 or less when said standard deviation is calculated around a mean or average impedance of 90 to 110 ohms.

2. The cable of claim 1 wherein, said cable has a rating at least out to 600 MHz; and said standard impedance deviation is measured on a 328 ft. or longer cable with at least 350 frequency measurements taken from 1.0 to 600 MHz and said standard impedance deviation is 3.5 or less and calculated around the mean or average impedance of 90 to 110 ohms.

3. The cable of claim 2 wherein, said shielding tape has a width of 0.5 to 1.5 inches.

4. The cable of claim 1 further comprising at least four of said helical shielded twisted pair cables, a jacket surrounding said at least four bound helical shielded twisted pair cables to provide a high performance data cable;

said high performance data cable is rated at least out to 600 MHz;

said high performance data cable has an adjusted to 20° C. average standard impedance deviation of 3.5 or less when taken on a 328 ft. or longer high performance data cable; and said average standard impedance deviation is the average of all of the standard impedance deviations measured on each of said at least four helical-shielded twisted pair cables with at least 350 frequency measurements from 1.0 to 600 MHz and calculated around the mean or average impedance of 90 to 110 ohms, and no single standard impedance deviation is greater than 4.5 from said mean or average impedance.

5. The cable of claim 4 wherein said shielding tape has a width of 0.5 to 1.5 inches.

6. The cable of claim 5 wherein the cable is bundled prior to being jacketed.

7. A method of preparing a helical twisted pair data cable comprising providing an individual insulated twisted pair cable;

helically wrapping said twisted pair cable with a metal shielding tape to provide a helical shielded twisted pair cable with an overlap of said shielding tape and said shielding tape having a metal thickness of 0.75 to 1.25 mils, and said shielding tape being selected from the group consisting of a metal tape, a first composite tape having a non-metal base and a layer of metal on one side of said base, and a second composite tape having a non-metal base and a layer of metal on both sides of said base; and helically wrapping the metal shield with an overlap of 45–55% and at a angle to the longitudinal axis of the twisted pair cable of 30–45° and at a tension to eliminate a substantial amount of the air to leave a cross-sectional void area of less than 18% of the cross-sectional area of the shielded twisted pair cable to provide said helical shielded twisted pair data cable; and to provide said helical shielded twisted pair cable with a rating out to 600 MHz and an adjusted to 20° C. standard impedance deviation of 3.5 or less when said standard impedance deviation is measured on a 328 ft. or longer cable with at least 350 frequency measurements being taken and the standard impedance being calculated around a mean or average impedance of 50 to 200 ohms.

8. The method of claim 7 further comprising bundling at least four of said helical shielded twisted pair cables; and extruding a jacket over the at least four bundled helical shielded twisted pair cables to provide a high performance data cable.

9. The method of claim 7 wherein said at least 350 frequency measurements are from 1.0 to 600 MHz and calculated around the mean or average impedance of 90 to 110 ohms, and no single standard impedance deviation is greater than 4.5 from said mean or average impedance.

10. The method of claim 9 further comprising bundling at least four of said helical shielded twisted pair cables; and extruding a jacket over the at least four bundled helical shielded twisted pair cables to provide a high performance data cable.

* * * * *